US005836090A

United States Patent [19]

Smith

[11] Patent Number: 5,836,090

[45] Date of Patent: Nov. 17, 1998

[54] NON-SLIP SANDAL WITH WHOLLY REPLACEABLE PARTS

[75] Inventor: Douglas N. Smith, Grants Pass, Oreg.

[73] Assignee: Korkers, Inc., Grants Pass, Oreg.

[21] Appl. No.: 754,191

[22] Filed: Nov. 12, 1996

[51] Int. Cl.[6] ..... A43B 3/12; A43B 5/00

[52] U.S. Cl. ..... 36/7.6; 36/11.5; 36/134; 36/15

[58] Field of Search ..... 36/7.6, 7.5, 11.5, 36/110, 134, 67 D

[56] References Cited

U.S. PATENT DOCUMENTS

| | | | |
|---|---|---|---|
| 577,475 | 2/1897 | Zandalazini | 36/7.6 |
| 1,315,482 | 9/1919 | Dyer . | |
| 1,827,224 | 10/1931 | East | 36/67 D |
| 1,851,778 | 3/1932 | Skillen . | |
| 2,193,943 | 3/1940 | Shea | 36/7.6 X |
| 2,260,037 | 10/1941 | Lazarus . | |
| 2,268,435 | 12/1941 | Zucker . | |
| 2,292,238 | 8/1942 | Pierce et al. | 36/67 D X |
| 2,538,182 | 1/1951 | Young | 36/7.6 |
| 2,547,812 | 4/1951 | Carabatsos . | |
| 2,685,141 | 8/1954 | Davenport . | |
| 2,720,714 | 10/1955 | Krohn et al. . | |
| 2,726,461 | 12/1955 | Smith . | |
| 2,932,910 | 4/1960 | Brown . | |
| 3,019,533 | 2/1962 | Smith . | |
| 3,021,617 | 2/1962 | Koch | 36/7.6 |
| 3,156,988 | 11/1964 | Rause | 36/7.6 X |
| 3,584,402 | 6/1971 | Silverman . | |
| 3,587,181 | 6/1971 | Bernier | 36/134 X |
| 3,699,672 | 10/1972 | Sims . | |
| 3,726,028 | 4/1973 | Stokes . | |
| 3,834,045 | 9/1974 | Crigger et al. | 36/7.6 |
| 4,251,932 | 2/1981 | Love . | |
| 4,258,137 | 3/1981 | Cogliano . | |
| 4,262,434 | 4/1981 | Michelotti | 36/67 D |
| 4,674,205 | 6/1987 | Anger . | |
| 4,779,360 | 10/1988 | Bible . | |
| 4,782,604 | 11/1988 | Wen-Shown | 36/67 D X |
| 4,877,814 | 10/1989 | Ito . | |
| 4,897,935 | 2/1990 | Fel . | |
| 5,165,821 | 11/1992 | Fischer et al. . | |
| 5,228,216 | 7/1993 | Sargeant | 36/7.5 X |
| 5,243,775 | 9/1993 | Swain | 36/134 |
| 5,259,125 | 11/1993 | Gromes . | |
| 5,336,708 | 8/1994 | Chen . | |
| 5,350,777 | 9/1994 | Yuge et al. . | |
| 5,377,431 | 1/1995 | Walker et al. | 36/134 |
| 5,386,651 | 2/1995 | Okamoto | 36/134 |
| 5,469,644 | 11/1995 | Vidler . | |
| 5,533,277 | 7/1996 | Bell et al. | 36/7.6 |

FOREIGN PATENT DOCUMENTS

| | | | |
|---|---|---|---|
| 1033312 | 7/1953 | France . | |
| 82 22 514 | 10/1982 | Germany . | |
| 311791 | 10/1993 | Italy | 36/7.6 |
| 195311 | 1/1938 | Switzerland | 36/7.6 |
| 2 072 486 | 10/1981 | United Kingdom . | |

OTHER PUBLICATIONS

Official Gazette, Apr. 2, 1996, p. 713, illustrating design patent D 368,359, Spiked Shoe Cover.

DEU 1766434 drawing and claims (one page).

*Primary Examiner*—Ted Kavanaugh

*Attorney, Agent, or Firm*—Klarquist Sparkman Campbell Leigh & Whinston, LLP

[57] ABSTRACT

A non-slip sandal for attaching over a shoe or boot to provide traction on slippery surfaces is described. The sandal has a soleplate, upstanding sidewalls circumscribing the periphery of the soleplate, and straps attached to the sidewalls for securing the sandal over the shoe or boot. The sandal may be equipped with replaceable studs protruding from the bottom surface of the sandal for resisting slippage on the surface underneath the sandal. The replaceable studs have threaded shafts that are received by threaded nuts, which are molded into the bottom surface of the soleplate. Alternatively, the sandal may be equipped with a replaceable layer of a synthetic foam material on the bottom of the soleplate.

19 Claims, 3 Drawing Sheets

NON-SLIP SANDAL WITH WHOLLY REPLACEABLE PARTS

This invention relates to a non-slip sandal having parts that are wholly replaceable.

BACKGROUND OF INVENTION

Non-slip sandals, sometimes called creepers, are attached over shoes or boots to provide traction on slippery or unwieldy surfaces. Non-slip sandals are often used for fishing to provide traction on the gravel, rocks, moss, sand, or other slippery surfaces and for negotiating inclined surfaces such as roofs to prevent slipping on the surface.

Prior sandals generally have had a soleplate made from a semi-flexible material and have utilized fabric straps or laces of one kind or another attached to the soleplate to secure the sandal to the shoe or boot, and have had caulks or spikes protruding from the bottom surface of the soleplate to provide traction.

The different components of the sandals wear at varying rates. Therefore, it is desirable that each different part of the sandal be replaceable.

It is also desirable that the sandals be quickly attachable over the shoe or boot and quickly detachable therefrom.

SUMMARY OF THE INVENTION

It is an object of the present invention to provide a non-slip sandal that can be quickly fastened to and unfastened from a shoe or boot.

Another object is to provide a non-slip sandal that has easily replaceable straps.

A further object is to provide a non-slip sandal having a bottom surface into which replaceable studs can be fastened.

Yet another object of the invention is to provide a sandal capable of receiving a variety of replaceable and interchangeable studs upon the bottom surface of the sandal so as to enable use of a type of stud particularly suited for providing traction on a certain type of difficult surface.

The foregoing and other advantages of the invention will become apparent from the following detailed description of the illustrated embodiments and the accompanying drawings.

In an illustrated embodiment of the invention, the sandal includes a soleplate, sidewalls for securely positioning a shoe or boot on the soleplate, a replaceable strap assembly attached to the sidewalls that laces over the shoe for securing the sandal to the shoe, an ankle strap also for securing the sandal to the shoe, and replaceable studs that fit into fasteners in the bottom surface of the sandal for providing traction.

In another illustrated embodiment, the sandal is provided with a bottom layer of a synthetic foam material secured to the soleplate by means which permit its easy replacement.

DETAILED DESCRIPTION OF THE INVENTION

Figure 1:
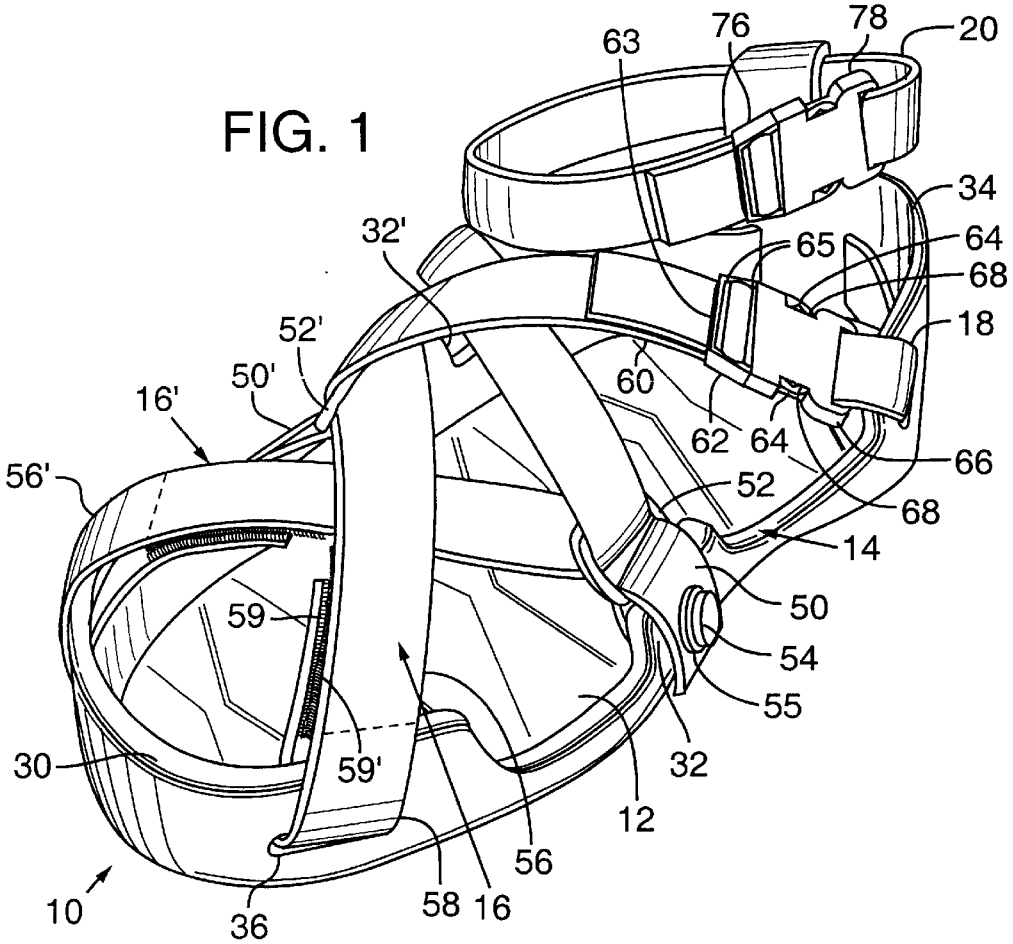
FIG. 1 is a perspective view of a non-slip sandal constructed in accordance with the present invention.

FIG. 1 illustrates a non-slip sandal 10 constructed in accordance with a preferred embodiment of the present invention. The sandal 10 comprises a soleplate 12, sidewalls 14 integral with the soleplate and projecting upwardly therefrom, a strap assembly comprising a pair of foot straps 16, 16', an ankle strap 20, various means to be described for securing the straps 16, 16' to the sidewalls 14, and replaceable studs 22.

The sandal 10 is adapted to be attached over a shoe or boot (not shown) to provide better traction on the surface underneath the sandal.

The soleplate 12 is sized to accommodate the sole of a shoe and shaped generally to mimic the outline of the sole of the shoe. The soleplate 12 preferably is constructed of a relatively stiff elastomer, such as synthetic rubber, so that the soleplate will flex to some extent when a user is walking but is sufficiently stiff to afford protection of a user's shoe sole and accomplish other desired functions which will become apparent hereinafter.

In the illustrated embodiment, the sidewalls 14 extend entirely around the periphery of the soleplate 12 and protrude upwardly normal to the upper surface of the soleplate 12. The sidewalls 14 prevent a shoe engaged on the sandal from slipping laterally and longitudinally off the soleplate 12. The sidewalls 14 have heightened portions, including a "U"-shaped toe portion 30 at the forward end of the sandal 10, left and right intermediate wall portions 32, 32' and a "U"-shaped heel wall portion 34 at the rearward end of the sandal 10. All the sidewalls 14 are preferably molded integrally with the soleplate 12.

Figure 2:
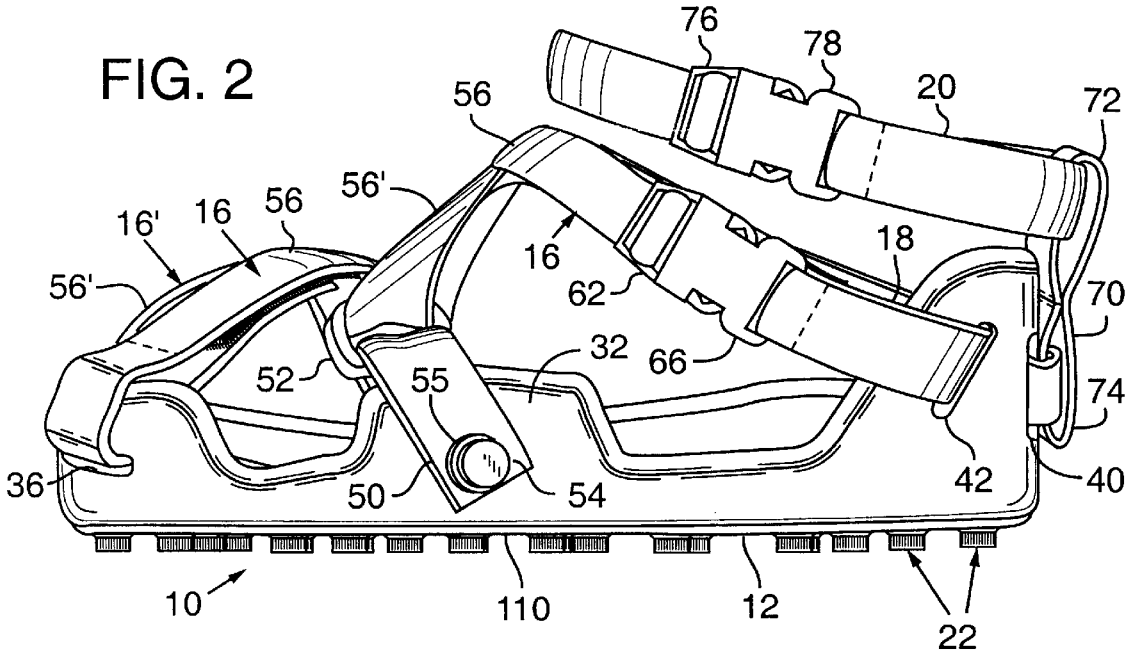
FIG. 2 is a side elevational view on a reduced scale of the sandal of FIG. 1.

The toe wall portion 30 has two opposite horizontal strap receiving slots 36 (FIG. 1), 36' (not shown), each positioned between the soleplate 12 and the top of the toe portion 30. The heel wall 34 has four strap receiving slots: two rear vertical slots 40, 40' and two slanted side slots 42 that slant upwardly toward the rear of the sandal 10. One of each of the rear vertical slots 40, 40' and the slanted side slots 42 is illustrated in FIG. 2.

Figure 8:
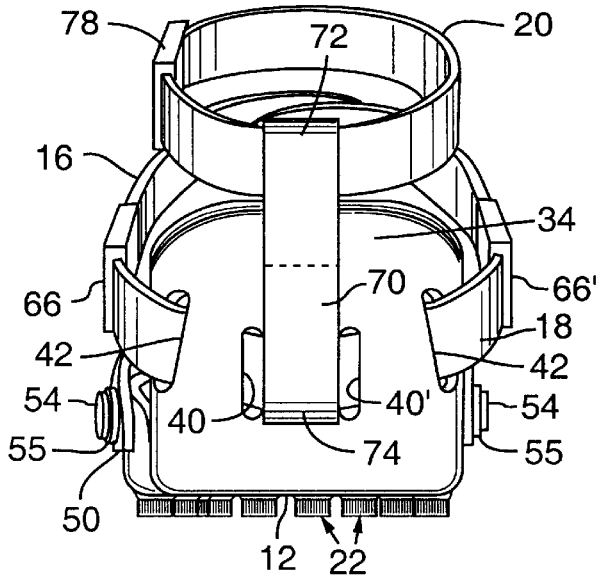
FIG. 8 is a rear view of the sandal of FIG. 1.

Each intermediate wall 32, 32' has a ring-securing strap 50, 50' looped therearound and secured thereto by a male-female type threaded fastener 54 extending through holes (not visible) in the ends of the straps and the walls 32, 32'. To provide a larger bearing surface, washers 55 preferably are placed underneath the heads of the fasteners 54 on the exterior of the intermediate walls 32, 32', as illustrated in FIG. 8, and the heads on the interior of the intermediate walls 32, 32', as partially illustrated in FIG. 4. The straps 50, 50' preferably are made of a flat nylon fabric, as are all the straps on the sandal 10.

Each ring strap 50, 50' extends through a "D"-shaped ring 52, 52', preferably made of a high strength synthetic plastic material. As will be explained below, the "D"-shaped rings 52, 52' receive the straps 16, 16' at locations above the intermediate walls 32, 32' but preferably below the top of the shoe placed thereon.

The forward end 58 of the strap 16 is looped through the horizontal slot 36 in the toe wall 30 and is secured in place by a hook and loop fastening system, such as pieces of "VELCRO" brand fastener 59, 59', that are sewn and/or cemented onto the forward end 58 of the strap 16 and a facing portion of the looped strap, respectively, as best seen in FIG. 1. The strap 16 extends transversely and rearwardly across the sandal 10, is threaded through the right "D"-shaped ring 52', from which it extends rearwardly and transversely across the sandal 10, the rearward end 60 of the strap 16 being releasably secured to the heel wall 34, as will be described in greater detail below. In like manner, one end of the strap 16' is looped through the slot 36', and secured by, for example, "VELCRO" brand fasteners, looped through the ring 52, and releasably secured to the heel wall 34 on the side opposite the strap 16.

When the straps 16, 16' are assembled, as just described, the straps criss-cross over one another to form two "X"s, as can best be seen in FIG. 1, that can be tightened down over the top of a shoe placed on the soleplate 12.

The rearward ends of the strap 16, 16' each have a commercially available male bayonet fastener attached thereon. Only the fastener 62 attached to the end 60 of the strap 16 is visible in the drawings, but the strap 16' has an identical fastener secured thereto. The fastener 62 has two flexible latches 64 and an adjustment portion 63 having three lateral, spaced-apart guides 65 (two of which can be seen in FIG. 1). The strap 16 is threaded from the underside of the male fastener 62 into the space near the first guide, over the second guide, and out the space near the third guide. This threading removably secures the strap 16 on the male fastener 62 and allows the male snap fastener 62 to be moved lengthwise along the strap 16 to vary the effective length of the strap 16 (the distance from the toe wall 30 to the location of the male snap fastener 62 on the strap 16) to accommodate different sizes of shoes and boots.

The rear vertical slots 40, 40' and the side slanted slots 42 on the heel wall 34 receive the heel strap 18, which preferably also is made from a flat nylon fabric. In the illustrated embodiment, the heel strap 18 extends from the exterior of the heel wall 34 into the left side slanted slot 42, along the interior of the heel strap 18, out through the rear vertical slot 40, along the exterior of the heel wall 34, back in the other rear vertical slot 40', along the interior of the heel wall 34, and back out the right slanted slot 42. The opposite ends of the heel strap 18 have commercially available female snap fasteners 66, 66', respectively, attached thereon (the left female snap fastener being visible in FIGS. 1 and 2). Each illustrated female snap fastener 66 is a hollow "H"-shaped member having openings 68 on the cross-bar of the "H." The hollow area in the female snap fastener 66 is slightly smaller than the distance between the latches 64 on the male snap fastener 62 when the latches are in a free position. Therefore, when the male snap fastener 62 is inserted into the hollow area on the female snap fastener 66, the latches 64 deform slightly inward and snap back into the free position when they reach the openings 68, thereby securing the male and female snap fasteners 62 and 66 together. The fastener 66' is constructed and functions identically with the fastener 62. This type of snap fastener is commonly used for quickly connecting and disconnecting flaps on backpacks and in many other environments.

Although male and female snap fasteners are illustrated in the present embodiment, it should be understood that other types of buckles, latches, and fastening mechanisms are equally suitable. Also, the positions of the male snap fasteners and female snap fasteners could be reversed.

As illustrated in FIG. 2, a double loop strap 70 having a top loop 72 and a bottom loop 74 through which the heel strap 18 extends, is provided for connecting the ankle strap 20 to the sandal 10 while allowing the ankle strap 20 to be positioned at various angular positions to the soleplate 12. The double loop 70 is formed by folding both ends of a flat strap to the center of the strap and then sewing, or otherwise attaching, the ends thereto.

The ankle strap 20 extends through the top loop 72 of the double loop 70 and has a male snap fastener 76 on one end and a female snap fastener 78 on the other end. The snap fasteners are constructed the same as those previously described, with the male snap fastener 76 being adjustable to vary the length of the ankle strap 20. The ankle strap 20 is positioned around the wearer's ankle, and the male and female snap fasteners 76 and 78 are joined so that the ankle strap 20 secures the sandal 10 relative to the wearer's leg.

The configuration of the foot straps 16, 16' and the heel and ankle straps 18 and 20 allows each strap to be removed from the sandal 10 separately and easily replaced.

Figure 3:
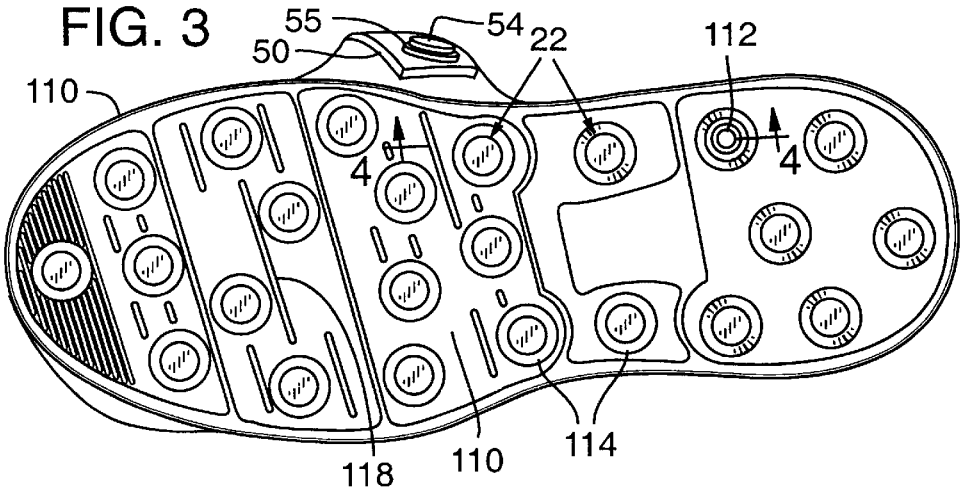
FIG. 3 is a bottom view on a reduced scale of the sandal of FIG. 1.
Figure 4:
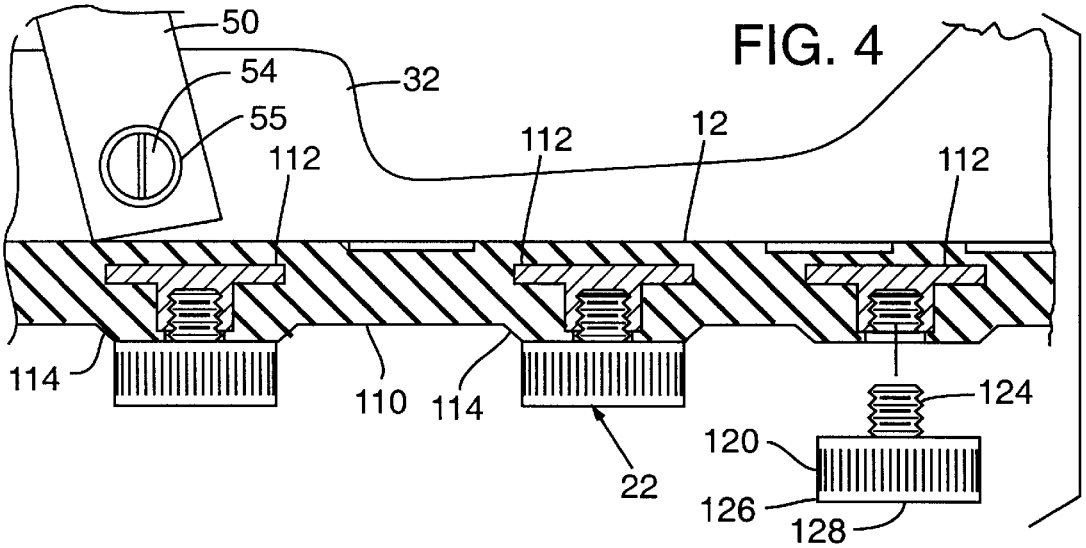
FIG. 4 is an enlarged cross-sectional view taken along line 4—4 of FIG. 3.

The bottom surface 110 of the soleplate 12 has studs 22 extending downwardly therefrom at interspersed locations, as illustrated in FIG. 3. Each stud 22 is secured to the soleplate 12 by a threaded nut 112 that is molded into the soleplate 12, as illustrated in FIG. 4. At the location of each nut 112, a thickened boss or reinforcing ring 114 is molded around the opening in which the nut 112 sits. As the reinforcing ring 114 protrudes outwardly from the bottom surface 110, the outer diameter of the reinforcing ring 114 decreases so that the reinforcing ring is essentially a hollow frusto-conical protrusion.

The bottom surface 110 may also have reinforcing ribs 118 extending laterally across the soleplate 12, as shown in FIG. 3, or other shapes or sizes of ribs.

The molded-in nuts 112 allow the sandal 10 of this invention to accommodate a variety of studs 22 to adapt the sandal to the environment in which it will be used. Each variety of stud has an exposed head 120 that protrudes in a direction normal to the bottom surface 110 of the soleplate 12 and a threaded shaft 124 extending from the head 120 for threading the stud 22 into the nut 112 for securing therein. Different forms of exposed heads 120 are made for resisting slipping on different types of surfaces.

One type of exposed head 120 is a knurled, cylindrical aluminum cap 126, as illustrated in FIGS. 1–4. Such studs are particularly useful in providing traction on muddy river bottoms and on rocky surfaces. The aluminum caps 126 have a flat, smooth major planar surface 128 substantially parallel to the bottom surface 110 of the soleplate 12 and are preferably knurled on the exterior sides of the cylinder for assisting in insertion and removal of the caps 126.

Figure 5:
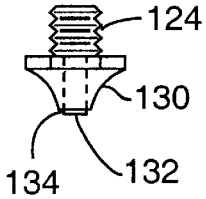
FIG. 5 is a side elevation of a carbide center spike stud for use on the sandal of FIG. 1.

Alternatively, the exposed head 120 could be a carbide centered spike 130, as illustrated in FIG. 5. The bottom of the illustrated carbide centered spike 130 is hexagonal shaped and tapers upwardly therefrom to terminate in a flat tip 132, forming essentially a conical shape with a flat tip. At the flat tip 132, there is a thin cylindrical wall into which a cylindrical carbide center 134 is inserted. Preferably, a washer (not shown) having a diameter larger than the hexagonal-shaped bottom of the spike 130 is inserted between the spike 130 and the soleplate 12 to improve stability of the spike 130.

Figure 7:
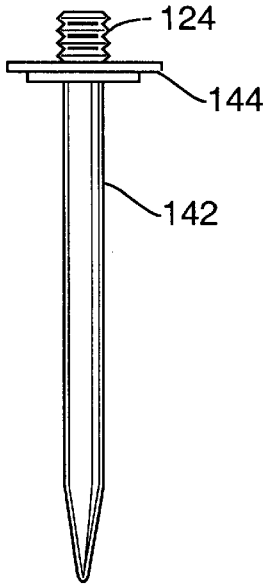
FIG. 7 is a side elevation of a long steel spike for use on the sandal of FIG. 1.
Figure 6:
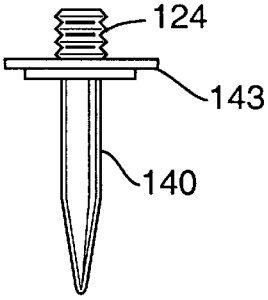
FIG. 6 is a side elevation of a steel spike for use on the sandal of FIG. 1.

The exposed head 120 could also take the form of a sharp steel spike 140 having a shoulder and a tapered shaft, as shown in FIG. 6, for use on surfaces, such as roof shingles or logs of wood, or a longer steel spike 142, as shown in FIG. 7, for providing traction on snowy surfaces. Each spike 140, 142 preferably has a washer 143, 144 abutting its shoulder to improve stability of the spikes.

Because all the varieties of studs 22 have equivalent threaded shafts 124, the studs can be quickly interchanged with any of the other types of studs by unscrewing the studs from the nuts 122. Thus, one pair of sandals 10 can be used on a wide variety of slippery surfaces.

Figure 9:
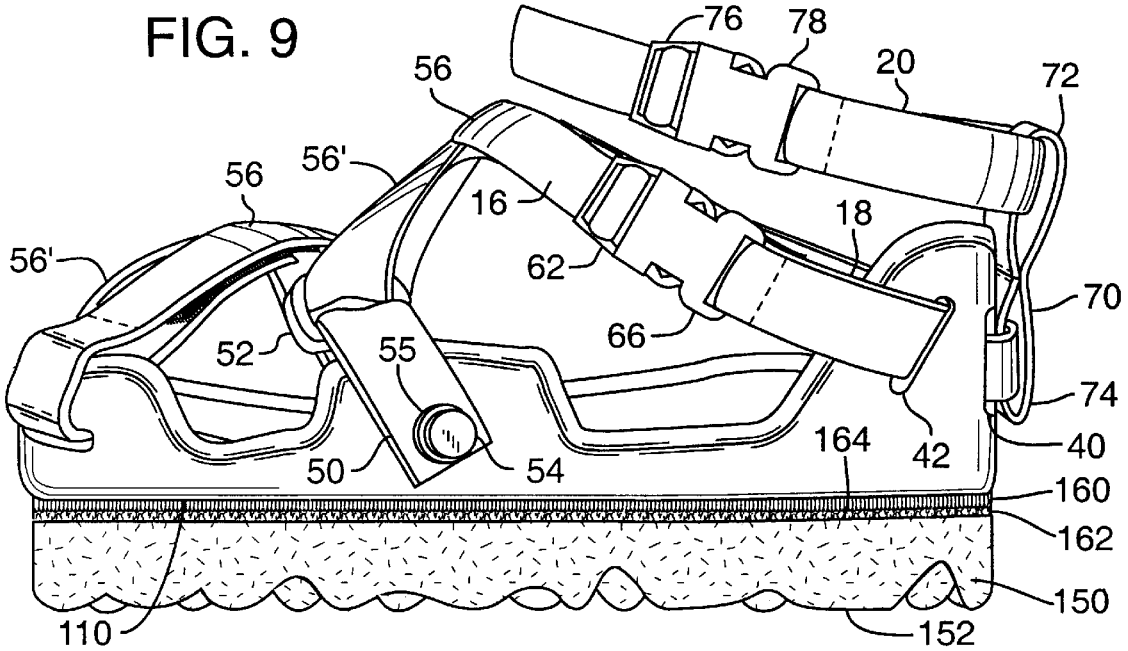
FIG. 9 is a side elevational view on a reduced scale of an alternative embodiment of the sandal, including a foam sole.
Figure 10:
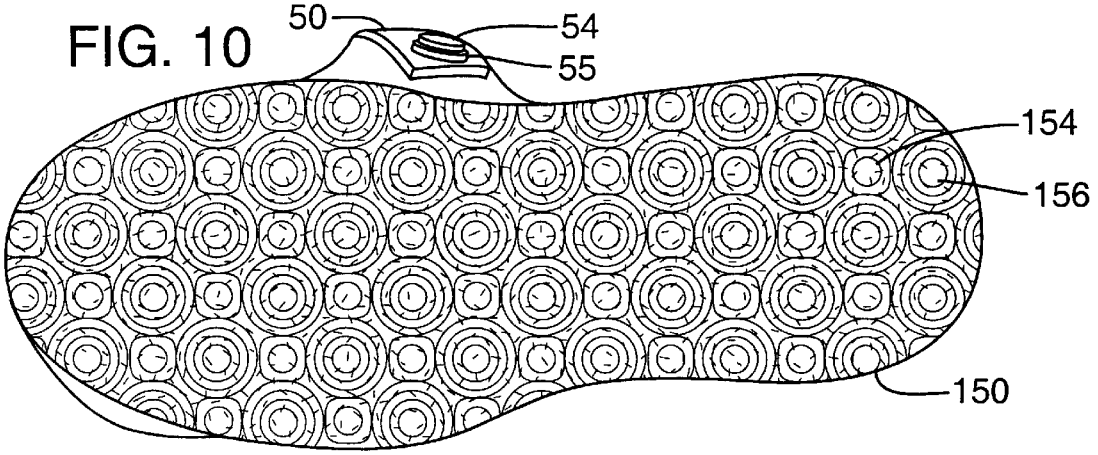
FIG. 10 is a bottom view of the sandal of FIG. 1.

As an alternative to using studs, the sandal 10 could be provided with a sole 150, as illustrated in FIGS. 9 and 10, comprising a foamed, synthetic resin more particularly described below. The sole 150 is suitable for use on slippery surfaces such as wet, oily, or soapy surfaces and, in particular, on roofs.

The illustrated sole 150 is cut to fit the outline of the bottom of the sandal 10. The preferred sole material has a flat, top surface 164 and a bottom surface 152 having bumps 154 with a somewhat square-shaped cross-section and recesses 156 that are substantially cone-shaped with a rounded tip. However, the bottom surface 152 could be flat or otherwise shaped with bumps.

The illustrated sole 150 is preferably made from a foamed polyurethane sheet which is flexible, non-reticulated, convoluted, 1⅜ inch over ½ inch (meaning that the distance between the top of the bump and the bottom of the recess is 1⅜ inch and the distance between the top of the bump and the top of the recess is ½ inch), of 1.4 pounds per cubic foot density and 36 indent load deflection, available from Hickory Springs Manufacturing Company of Hickory, N.C., among others.

The sole 150 is removably fastened to the bottom surface 110 of the soleplate 12 by a hook and loop fastening system, such as "VELCRO", although other fastening systems could be used. The illustrated hook and loop fastening system has a hook piece 160 attached to the bottom surface 110 of the soleplate 12 and a loop piece 162 attached to the top surface 164 of the sole 150, although the positions of the hook and loop pieces 160 and 162 could be reversed. The illustrated hook piece 160 is made of molded vinyl and has a hook height of 0.05 inches and a hook tip of 0.018 inches, although other hook pieces would be suitable. Preferably the loop piece 162 is made from polyester so as to inhibit absorption of moisture or oils.

The hook and loop pieces 160, 162 preferably are fastened to their respective surfaces using a cement, such as a waterproof contact cement from the chemical family chloroprene rubber and synthetic resin solution in a hydrocarbon solvent blend, available from Columbia Cement Company, Incorporated of Fremont, N.Y., among others.

By preventing slipping, the sole 150 increases safety of the wearer, especially on surfaces where marginal slippage could have serious consequences, such as roofs. A further advantage of the sole 150 is that it does not damage the roof or other undersurface.

To attach the sandal 10 over the shoe or boot, the straps 16, 16' are loosened, if necessary, by slipping the straps forwardly through the "D"-shaped rings 52, 52'. The shoe is slid underneath the straps 16, 16' and between the sidewalls 14. The straps 16, 16' are then pulled taut over the top of the shoe, and the male snap fasteners 62 are inserted into the female snap fasteners 66, 66'; whereafter the ends of the straps 16, 16' may be pulled to secure the shoe snugly on the sandal 10. The ankle strap 20 is then fastened around the ankle by inserting the male snap fastener 76 into the female snap fastener 78.

As will be apparent to those of ordinary skill in the art, the invention permits of modification in arrangement and detail. I claim such modifications as come within the scope of the appended claims.

What is claimed is:

1. A non-slip sandal for attaching over a shoe having a sole, said sandal comprising:

a soleplate sized to accommodate said sole of said shoe, said soleplate having an upper surface and a bottom surface, said bottom surface having a plurality of threaded nuts molded therein, the soleplate also having forward and rear ends;

at least one upstanding member attached to said soleplate for locating said shoe on said soleplate, the upstanding member being semi-rigid and positioned for preventing the shoe from moving laterally off the forward and rear ends of the soleplate;

means for fastening said soleplate to said shoe comprising a forward strap assembly, said forward strap assembly including two ends that are releasably attached to said upstanding member; and a rear strap attached to said upstanding member and extending forwardly from said rear end of said soleplate for connecting with said forward strap assembly to secure said sandal on said shoe; and a plurality of slip-resistant studs, each stud having a threaded shaft protruding therefrom for threading into said nuts in said bottom surface of said soleplate, said studs being removable from said nuts so as to allow replacement of any one of said studs.

2. The sandal of claim 1 in which each of said studs has a head that is an aluminum cap.

3. The sandal of claim 1 in which each of said studs has a head with a hexagonal-shaped base that tapers to a flat tip and has a carbide center spike insert.

4. The sandal of claim 1 in which each of said studs has a spiked head attached to the threaded shaft, the spiked head for providing traction on snowy surfaces and having a length of at least six times as long as the length of the threaded shaft.

5. The sandal of claim 1 further comprising a reinforcing ring protruding from said bottom surface of said soleplate, said ring defining a hole into which sits one of said nuts.

6. A non-slip sandal for attaching over a shoe having a sole, said sandal comprising:

a soleplate sized to accommodate said sole of said shoe and being made of an elastomer, said soleplate having an upper surface and a bottom surface, said bottom surface having at least one slip-resistant member protruding downwardly therefrom;

an upstanding sidewall extending around at least a portion of the periphery of said soleplate for positioning said shoe on said soleplate, said sidewall having a first and second forward strap receiving slot and at least a first and second rearward strap receiving slot;

a replaceable strap assembly, said strap assembly having two forward ends, each forward end being looped through one of said first and second forward receiving slots in said sidewall, said forward ends having fastening means removably fastening said strap assembly to said sidewall, said strap assembly crossing transversely over said soleplate at least once; and a heel strap threaded through said first and second rearward receiving slots, said heel strap having a fastening means fastening said heel strap to said strap assembly so that when said shoe is inserted underneath said strap assembly, fastening said heel strap to said strap assembly secures said shoe to said soleplate.

7. The sandal of claim 6 in which said strap assembly includes a left strap and a right strap.

8. The sandal of claim 6 further comprising an intermediate strap removably attached to said sidewall near the longitudinal center of said sidewall, said intermediate strap having a loop, said strap assembly threaded through said loop in said intermediate strap.

9. The sandal of claim 8 further comprising a ring threaded onto said loop on said intermediate strap, said strap assembly threading through said ring.

10. The sandal of claim 6 further comprising a left and right ring attached to said sidewall near the longitudinal center thereof and in which said strap assembly includes a left strap and a right strap and in which said left strap extends from said first forward receiving slot laterally across said soleplate, through said right ring, and laterally back across said soleplate to be secured by said heel strap and in which said right strap extends from said second forward receiving slot laterally across said soleplate, through said left ring, and laterally back across said soleplate to be secured by said heel strap.

11. The sandal of claim 6 in which the slip-resistant member is made of synthetic foam.

12. The sandal of claim 11 in which the slip-resistant member is convoluted and substantially covers the bottom surface of the soleplate.

13. A non-slip sandal for attaching over a shoe having a sole, the sandal comprising:

a soleplate sized to accommodate said sole of said shoe, said soleplate having an upper surface and a bottom surface;

an upstanding sidewall extending around at least a portion of the periphery of said soleplate for positioning said shoe on said soleplate and resisting longitudinal and lateral movement of said shoe, the sidewall having a forward portion and a rear portion;

two forward straps releasably attached to said forward portion of said sidewall, the forward straps for extending over the top of said shoe;

a rear strap attached to said rear portion of said sidewall;

at least one fastening member connected to one of said forward and rear straps for fastening said rear strap to said front straps for securing said sandal around said shoe; and a plurality of slip-resistant members protruding from said bottom surface of said soleplate for preventing said soleplate from slipping relative to the ground.

14. The sandal of claim 13 further comprising a plurality of nuts molded into said bottom surface of said soleplate and in which said caps have threaded shafts for threading into said nuts.

15. The sandal of claim 13 in which said fastening means is a latch.

16. The sandal of claim 13 in which said slip-resistant members are knurled to facilitate insertion and removal of said slip-resistant members.

17. A non-slip sandal for attaching over a shoe having a sole, said sandal comprising:

a soleplate sized to accommodate said sole of said shoe and being made from an elastomer, said soleplate having an upper surface and a bottom surface;

an upstanding sidewall mounted to said upper surface of said soleplate for maintaining said shoe on said soleplate, said sidewall including an arcuate toe wall portion, two opposite intermediate wall portions, and a heel wall portion;

said toe wall portion having two forward horizontal strap receiving slots;

each intermediate wall portion having a hole therethrough;

said heel wall portion having a plurality of strap receiving slots including two rear vertical heel strap slots and two slanted side heel slots;

two intermediate straps, each intermediate strap being looped around one of said intermediate wall portions;

a fastener extending through each intermediate strap and said hole in each intermediate wall portion to removably fasten said loop to said intermediate wall portion;

a substantially "D"-shaped ring attached to each intermediate strap;

two foot straps for fastening said soleplate to said shoe, each foot strap having a forward end extending through one of said forward receiving slots in said toe wall portion and looped around to be fastened to the underside of itself so that each said foot strap is fastened to said toe wall portion, each said foot strap also threading through a ring on the side of said soleplate opposite said forward slot through which a said strap was looped so that when both foot straps are assembled said foot straps criss-cross over the top of said soleplate, each foot strap having a rearward end with a male snap fastener attached thereon;

a heel strap threaded through said rear and side heel slots and having two ends and a pair of female snap fasteners attached one to each end;

a double loop made from a flat strap by folding over each end of said flat strap to a location near the center of said flat strap and being secured thereon so as to form a top loop and a bottom loop, said bottom loop being looped around said heel strap between said rear heel slots;

in which said male snap fasteners on said foot straps snap into said female snap fasteners on said heel strap for fixating said soleplate relative to said shoe;

an ankle strap threaded through said top loop of said double loop, said ankle strap having a first and second end, said first end having a male snap fastener attached thereon and said second end having a female snap fastener attached thereon and adapted to receive the male snap fastener secured to said ankle strap first end so that said ankle strap can be secured around an ankle;

a plurality of bosses protruding from said bottom surface of said soleplate;

a plurality of nuts, each nut being molded into one of said bosses; and a plurality of slip-resistant studs threaded into said nuts.

18. The sandal of claim 17 in which said slip-resistant studs are knurled aluminum caps having a major, planar surface substantially parallel to said bottom surface of said soleplate.

19. The sandal of claim 17 in which said slip-resistant studs are carbide center spikes.

* * * * *